US008146680B2

(12) United States Patent
Mock et al.

(10) Patent No.: US 8,146,680 B2
(45) Date of Patent: Apr. 3, 2012

(54) ANTI-STALL TOOL FOR DOWNHOLE DRILLING ASSEMBLIES

(75) Inventors: Philip Wayne Mock, Costa Mesa, CA (US); Rudolph Ernst Krueger, IV, Houston, TX (US)

(73) Assignee: WWT International, Inc., Houston, TX (US)

( * ) Notice: Subject to any disclaimer, the term of this patent is extended or adjusted under 35 U.S.C. 154(b) by 235 days.

(21) Appl. No.: 12/348,778

(22) Filed: Jan. 5, 2009

(65) Prior Publication Data

US 2009/0173540 A1 Jul. 9, 2009

Related U.S. Application Data

(60) Provisional application No. 61/009,972, filed on Jan. 3, 2008, provisional application No. 61/082,931, filed on Jul. 23, 2008.

(51) Int. Cl.
*E21B 19/086* (2006.01)

(52) U.S. Cl. ..... 175/27; 175/321

(58) Field of Classification Search ..... 175/27, 175/321

See application file for complete search history.

(56) References Cited

U.S. PATENT DOCUMENTS

| | | | | |
|---|---|---|---|---|
| 3,675,727 A | | 7/1972 | Clark | |
| 3,799,260 A | | 3/1974 | Barrington | |
| 4,223,746 A | | 9/1980 | Tanguy et al. | |
| 4,431,064 A | | 2/1984 | Bright | |
| 4,660,656 A | * | 4/1987 | Warren et al. | 175/26 |
| 4,721,172 A | | 1/1988 | Brett et al. | |
| 4,768,598 A | | 9/1988 | Reinhardt | |
| 4,936,397 A | | 6/1990 | McDonald et al. | |
| 5,174,392 A | | 12/1992 | Reinhardt | |
| 5,311,954 A | * | 5/1994 | Quintana | 175/61 |
| 5,368,108 A | | 11/1994 | Aldred et al. | |
| 5,368,110 A | | 11/1994 | French | |
| 5,372,193 A | | 12/1994 | French | |
| 5,394,951 A | | 3/1995 | Pringle et al. | |
| 5,421,420 A | * | 6/1995 | Malone et al. | 175/61 |
| 5,476,421 A | | 12/1995 | Moore et al. | |

(Continued)

FOREIGN PATENT DOCUMENTS

GB 2 439 178 A 12/2007

(Continued)

OTHER PUBLICATIONS

Dictionary definitions of "Open loop" "closed loop" and "feedback", accessed Oct. 7, 2011 via thefreedictionary.com.*

(Continued)

*Primary Examiner* — Jennifer H Gay
*Assistant Examiner* — Blake Michener
(74) *Attorney, Agent, or Firm* — Christie, Parker & Hale, LLP

(57) ABSTRACT

An anti-stall tool in an oil well drilling assembly that controls reciprocation of the drill bit by a controller that alters weight-on-bit (WOB) depending upon measured downhole pressure or torque at the downhole motor. The controller receives preset high and low working pressure limits for the downhole motor and keeps the drill bit rotating by maintaining WOB during normal drilling operations, increasing WOB if sensed working pressure indicates that drill bit loading or torque is undesirably low, and reversing WOB by retracting the drill bit if excessive working pressure or torque is sensed.

18 Claims, 4 Drawing Sheets

U.S. PATENT DOCUMENTS

| | | | | |
|---|---|---|---|---|
| 5,669,457 | A | 9/1997 | Sebastian et al. | |
| 5,806,611 | A | 9/1998 | Van Den Steen et al. | |
| 5,884,716 | A | 3/1999 | Beasley | |
| 6,003,606 | A * | 12/1999 | Moore et al. | 166/381 |
| 6,102,138 | A | 8/2000 | Fincher | |
| 6,202,762 | B1 | 3/2001 | Fehr et al. | |
| 6,230,813 | B1 | 5/2001 | Moore et al. | |
| 6,230,821 | B1 * | 5/2001 | Warren et al. | 175/27 |
| 6,467,557 | B1 | 10/2002 | Krueger et al. | |
| 6,568,485 | B2 | 5/2003 | Falgout, Sr. | |
| 6,594,881 | B2 | 7/2003 | Tibbitts | |
| 6,679,341 | B2 * | 1/2004 | Bloom et al. | 175/51 |
| 6,758,279 | B2 | 7/2004 | Moore et al. | |
| 6,962,213 | B2 | 11/2005 | Hartwick | |
| 7,036,610 | B1 | 5/2006 | Vail, III | |
| 7,044,240 | B2 | 5/2006 | McNeilly | |
| 7,059,417 | B2 * | 6/2006 | Moore et al. | 166/381 |
| 7,100,708 | B2 | 9/2006 | Koederitz | |
| 7,114,581 | B2 | 10/2006 | Aronstam et al. | |
| 7,139,219 | B2 | 11/2006 | Kollé et al. | |
| 7,174,975 | B2 | 2/2007 | Krueger et al. | |
| 7,854,275 | B2 * | 12/2010 | Mock et al. | 175/57 |
| 2001/0045300 | A1 * | 11/2001 | Fincher et al. | 175/26 |
| 2002/0007971 | A1 | 1/2002 | Beaufort et al. | |
| 2008/0202816 | A1 | 8/2008 | Haughom et al. | |
| 2008/0264689 | A1 | 10/2008 | Blount et al. | |
| 2009/0173539 | A1 | 7/2009 | Mock et al. | |

FOREIGN PATENT DOCUMENTS

| | | | |
|---|---|---|---|
| NO | 324265 | B1 | 9/2007 |
| WO | WO 2004/090278 | A1 | 10/2004 |
| WO | WO 2006/075921 | A1 | 7/2006 |
| WO | WO 2008/134263 | A1 | 11/2008 |
| WO | WO 2009/089187 | A3 | 7/2009 |
| WO | WO 2009/089188 | A3 | 7/2009 |

OTHER PUBLICATIONS

International Search Report and Written Opinion of the International Searching Authority dated Feb. 7, 2011 for International Application No. PCT/US2009/030165, Filed Jan. 5, 2009; 12 Pages.

International Search Report and Written Opinion of the International Searching Authority dated Feb. 7, 2011 for International Application No. PCT/US2009/030166, Filed Jan. 5, 2009; 12 Pages.

* cited by examiner

ANTI-STALL TOOL FOR DOWNHOLE DRILLING ASSEMBLIES

CROSS-REFERENCE

This application claims the priority date of U.S. Provisional Applications 61/009,972, filed Jan. 3, 2008, and 61/082,931, filed Jul. 23, 2008. These priority applications are incorporated herein in their entirety by this reference.

FIELD OF THE INVENTION

This invention relates to downhole drilling assemblies, and more particularly, to an anti-stall tool for controlling weight-on-bit during drilling operations.

BACKGROUND

Coiled tubing drilling requires the use of a downhole positive displacement motor (PDM) to rotate the drill bit. During drilling operations, the unloaded PDM rotates at a constant RPM and achieves a "freespin" motor pressure, with respect to the fluid flow rate. As the drill bit encounters the bottom of the hole and force is transferred to the bit, referred to as weight-on-bit (WOB), the motor will sense an increase in torque. This increase in torque is a result of increased resistance to rotating at the constant RPM (assuming a constant flow rate). In turn, the PDM requires additional pressure to turn the motor at the constant RPM while under increased resistance. If the resistance increases to a condition which prohibits the PDM from rotating (i.e. excessive WOB), a motor stall is encountered. During a motor stall, the motor stops turning, the downhole fluid path is severely restricted, and the surface pump pressure dramatically increases. This event can eventually cause a motor failure, which requires the drilling process to be stopped, and the coiled tubing to be fatigue-cycled as the bit is pulled off bottom and run back into the hole to start drilling again.

A downhole tool that monitors motor pressure and sharply reduces the occurrence of motor stalls will increase overall drilling efficiency by:

(1) Increasing the average rate of penetration. This is achieved by reducing the occurrences of pulling off-bottom every time the motor stalls.

(2) Decreasing the damage to PDMs through repeated motor stalls, thereby decreasing occurrence of downhole failure.

(3) Decreasing the fatigue cycles on the coiled tubing. This increases the number of wells a coiled tubing string can service.

By achieving a more efficient drilling operation, the operators can substantially increase the cost savings of drilling a well.

The present invention provides an anti-stall tool that controls WOB during drilling operations, resulting in improved overall drilling efficiency.

SUMMARY OF THE INVENTION

Briefly, the invention comprises an anti-stall tool for use in a downhole assembly near the bottom of the tubing adjacent a positive displacement motor (PDM) and the drill bit. In one embodiment, the tubing comprises a coiled tubing, although the invention also can be used in rotary drilling applications. The anti-stall tool includes a controller that controls the force applied to the drill bit during drilling to prevent the drill bit from stalling under load. A working pressure range of the PDM is sensed during use by a hydraulic valve control system and is used as an input to the controller. The controller alters weight-on-bit (WOB) if the downhole pressure goes beyond either end of a preset working pressure range of the system. The controller keeps the drill bit rotating by (1) maintaining WOB during normal drilling operations, (2) increasing WOB if sensed PDM working pressure indicates that drill bit loading is low, and (3) reducing WOB which reduces PDM back-pressure to retract the drill bit from the bottom if excessive working pressure is sensed due to increased torque at the PDM.

The anti-stall tool generally comprises one or more hydraulic cylinders for applying an axial force either in a forward direction or a reverse direction. The controller comprises a system of hydraulic valves adapted to control piston force in either the forward or reverse directions. An active stage of the anti-stall tool reacts to the PDM producing low downhole pressures (e.g. below a preset low pressure) by actuating one or more of the pistons in the downhole direction to increase WOB which increases PDM back-pressure. When the PDM is operating within its normal operating pressure range, the controller locks the pistons in a passive mode, in which the pistons are sealed and the anti-stall tool transfers force from the tubing to the drill bit. If the controller senses a preset high pressure or greater due to high torque at the PDM, the valve system reverses hydraulic flow to the pistons, which reduces WOB to force the drill bit away from the bottom to reduce PDM back-pressure.

One embodiment of the invention comprises an anti-stall method for controlling drilling operations in a downhole assembly which includes a tubing that extends downhole, a drill bit carried on the tubing, a positive displacement motor (PDM) for rotating the drill bit, and an anti-stall tool adjacent the PDM. The method comprises sensing pressure in the PDM, providing a range of operating pressures for the PDM defined by high and low limits of operating pressures, and operating the anti-stall tool in: (1) an active stage for increasing WOB forces in the downhole direction when the low limit of operating pressure is sensed, (2) a reverse stage for providing a WOB force in the reverse direction when the high limit of operating pressure is sensed, and (3) an optional passive stage in which the anti-stall tool is locked to transfer WOB directly from the tubing to the drill bit when the PDM is operating within the limits of its normal operating pressure range.

Another embodiment comprises an improved anti-stall tool which produces a controlled translational motion of the drill bit that increases drilling efficiency. The anti-stall tool controls the force applied to the drill bit during drilling to prevent the drill bit from stalling under load. The anti-stall tool comprises one or more hydraulic cylinders for applying an axial force in either a forward or reverse direction, and a controller adapted to control the force applied by the one or more hydraulic cylinders to the drill bit in response to sensed working pressure of the drive motor during drilling operations. The controller comprises a system for adjusting WOB when working pressure exceeds either end of a working pressure range of the drive motor. The system includes (1) a passive stage for maintaining WOB when working pressure is within a preset normal operating range, (2) an active stage for applying pressure to the one or more cylinders to increase WOB when sensed working pressure is below a preset limit, and (3) a reverse stage for reversing pressure to the one or more cylinders to reduce WOB and thereby retract the drill bit from the bottom when sensed working pressure is above a preset limit. The tool is normally controlled to apply WOB at pressures within a desired wide range of pressures. When reaching a preset anti-stall pressure, the tool is reversed to reduce WOB and does not resume applying WOB over a preset wide range of PDM back-pressure drop.

In another embodiment, the tool can apply WOB during the wide range of operating pressures via at least two stages, one where pressure is increasing up to a set desired operating pressure, and then switches the tool to a locked position at that pressure and higher up to a preset anti-stall limit at which flow to the pistons is reversed to lift the drill bit. The two stages can be operated as active/reverse stages as well.

These and other aspects of the invention, including additional embodiments, will be more fully understood by referring to the following detailed description and the accompanying drawings.

DETAILED DESCRIPTION

Figure 1:
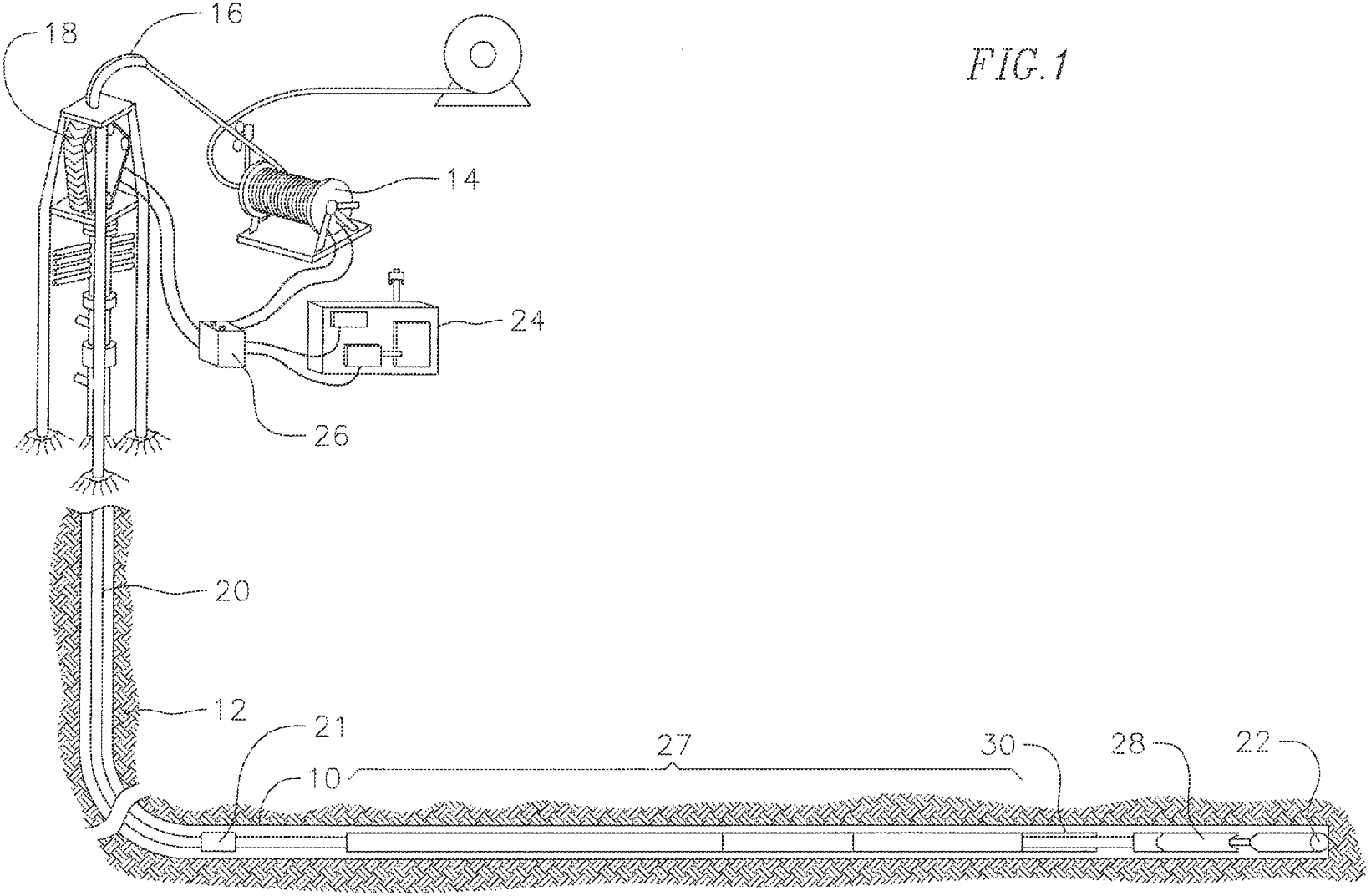
FIG. 1 is a schematic view showing a downhole assembly containing an anti-stall tool according to principles of this invention.

FIG. 1 is a schematic diagram illustrating a coiled tubing drilling system 10 for drilling a well bore in an underground formation 12. The coiled tubing drilling system can include a coiled tubing reel 14, a gooseneck tubing guide 16, a tubing injector 18, a coiled tubing 20, a coiled tubing connector 21, and a drill bit 22 at the bottom of the well bore. FIG. 1 also shows a control cab 24, a power pack 26, and an alignment of other BHA tools at 27. A tractor (not shown), such as that described in U.S. Pat. No. 7,343,982, may be used to move downhole equipment within the bore. The '982 patent is incorporated herein in its entirety by this reference. During drilling, the downhole equipment includes a downhole motor 28, such as a positive displacement motor (PDM), for rotating the drill bit. An anti-stall tool (AST) 30, according to principles of this invention, is positioned near the bottom of the coiled tubing, upstream from the downhole motor and the drill bit. In one embodiment, hydraulic back pressure produced within the coiled tubing is measured at the surface. Torque produced at the drill bit during drilling operations is directly related to back-pressure. As a result, hydraulic back-pressure measurements can be sensed and used as inputs to a hydraulic control valve system contained in the anti-stall tool.

The anti-stall tool 30 incorporates use of a series of hydraulic cylinders and as few as three pressure-actuated valves to control the applied weight-on-bit (WOB) while drilling. This tool will virtually create a real time, downhole motor pressure sensor that will alter the WOB to maintain a relatively constant drilling rate of penetration and provide feedback to the coiled tubing operator to adjust coiled tubing injector rates to match the PDM pressure.

The invention uses the working pressure range of the downhole positive displacement motor 28 to alter the WOB if the downhole pressure surpasses either end of the working range. During drilling operations, the AST controls WOB through the use of three distinct operations: active WOB, passive WOB and reverse.

Figure 2:
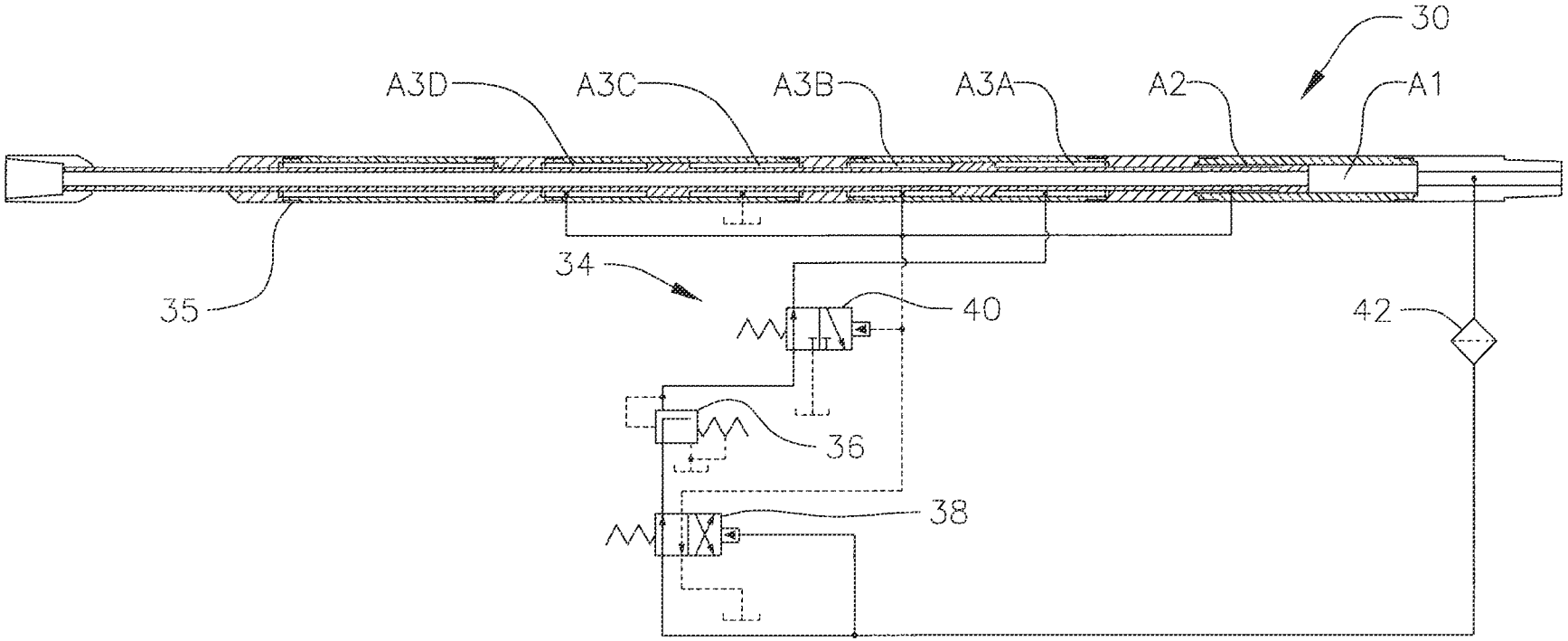
FIG. 2 shows a cross-sectional view of one embodiment of a hydraulic-operated anti-stall tool.

FIG. 2 illustrates one embodiment of the anti-stall tool 30 which includes a series of axially aligned hydraulic cylinders with separate pistons that define piston areas A1 and A2, A3A and A3B, and A3C and A3D. The torque section of the tool is shown at 35. FIG. 2 also schematically shows a controller 34 contained in the anti-stall tool. The controller includes a pressure reducing valve 36, a reverser valve 38, and a vent valve 40. Hydraulic control fluid passes through a filter 42.

In the description to follow, specific operating pressure set points or values are related to operative ranges for coiled tubing equipment. Use of the anti-stall tool in rotary drilling operations, for example, would involve use of different operating pressure ranges or control valve set points.

The first stage of the hydraulic anti-stall tool is activated when the unloaded PDM produces low downhole pressures. For example, if the PDM creates a back pressure of 200 psi (adjustable to specific motor requirements), the anti-stall tool will be in the active WOB stage. This causes pressure to be supplied to all pistons that will produce a force in the downhole direction (A1, A3A and possibly A3C). As the WOB is applied, the normal reaction is for the PDM to generate more pressure. As the anti-stall tool senses the increase in pressure to 250 psi (adjustable to specific motor requirements), the pressure reducing valve 36 will shut off additional flow to the pistons and hydraulically lock the pistons in the passive WOB stage.

In the passive WOB stage, the anti-stall tool transfers the force from the tubing to the bit. The tool is acting as a rigid member and is monitoring the PDM back-pressure. The pressure reducing valve 36 is closed and is sealing the fluid in the pistons (A3A and possibly A3C) that produce a force in the downhole direction. All of the resultant pressure from the WOB will be contained in the sealed piston volumes.

During the final stage of the anti-stall tool, the back pressure due to high torque in the PDM triggers the reverser valve 38 and vent valve 40 to reduce WOB. Once the back pressure reaches 1,000 psi (adjustable to specific motor requirements), the reverser valve 38 switches the flow of fluid to the pistons that produce force in the uphole direction (A2, A3B, A3D). At the same time, the vent valve 40 vents the opposite side of those pistons. This allows the tool to travel uphole, reducing WOB and thereby reducing the PDM back pressure. As the PDM back pressure falls below the reverser valve setting (including hysteresis) the reverser valve 38 will switch back to its original position.

The anti-stall tool is designed to be in the fully expanded position at low pressures. This bias allows the tool to have the full length of stroke available to retract as much as needed until the PDM back-pressure reduces below the lower limit of the vent valve. The anti-stall tool will then try to fully expand, but the pressure may rise to the pressure control valve setting or higher and limit the expansion. Therefore, the long stroke length will allow several retraction steps before the stroke length is used up. The coiled tubing operator can adjust the input speed of the coiled tubing into the hole to prevent the anti-stall tool from fully retracting. The operator will see a change in pump pressure with each retraction to signal the need to reduce the coiled tubing input speed.

The anti-stall tool operates as an open loop system. Drilling fluid from the surface is pumped down the bore in the tubing through the tool, to the motor for rotating the drill bit. Most of the fluid flow in the system is used for driving the drill bit. A small amount of the fluid is used for the controller and is jetted out to the sides and into the annulus during use.

The anti-stall tool includes splines in a torque section 44 which contains an outer spline housing and splines contained internally on the piston housing. The splines allow the BHA to maintain its orientation relative to the motor and drill bit, without undesired twisting. The splines allow the tool to be used with a steerable BHA. Steerable BHAs can be controlled to drill the hole to a desired location, while changing the direction of the hole while drilling to achieve this goal. The splines allow the PDM and bit to maintain alignment with the orienting tools that would be uphole of the anti-stall tool. The torque load is transferred from the PDM across the outermost housings and across the spline of the anti-stall tool to the tools uphole of the anti-stall tool. The inner shafts do not see direct loading due to torque. The spline section functions in both the expansion and retraction of the anti-stall tool.

Figure 3:
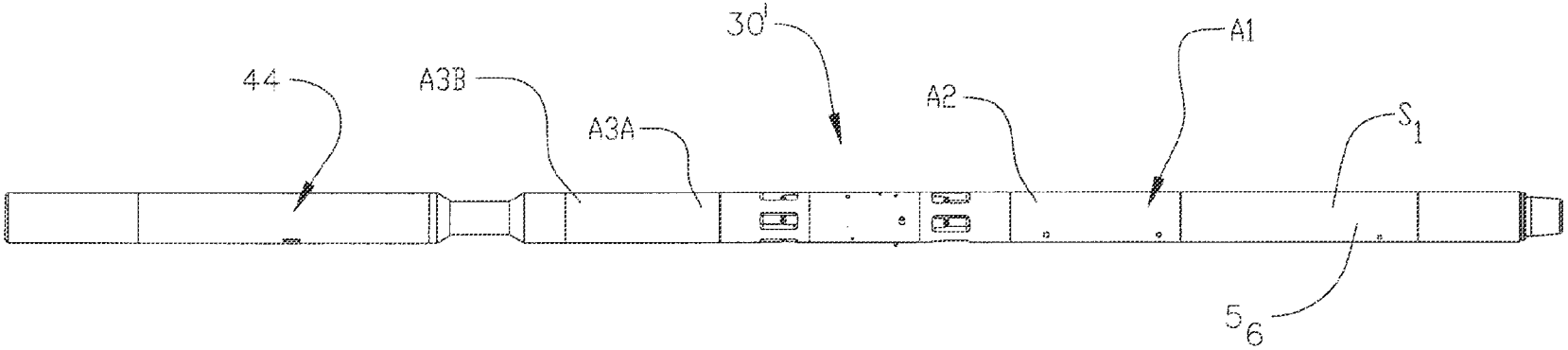
FIG. 3 is an elevational view showing a further embodiment of an anti-stall tool.
Figure 4:
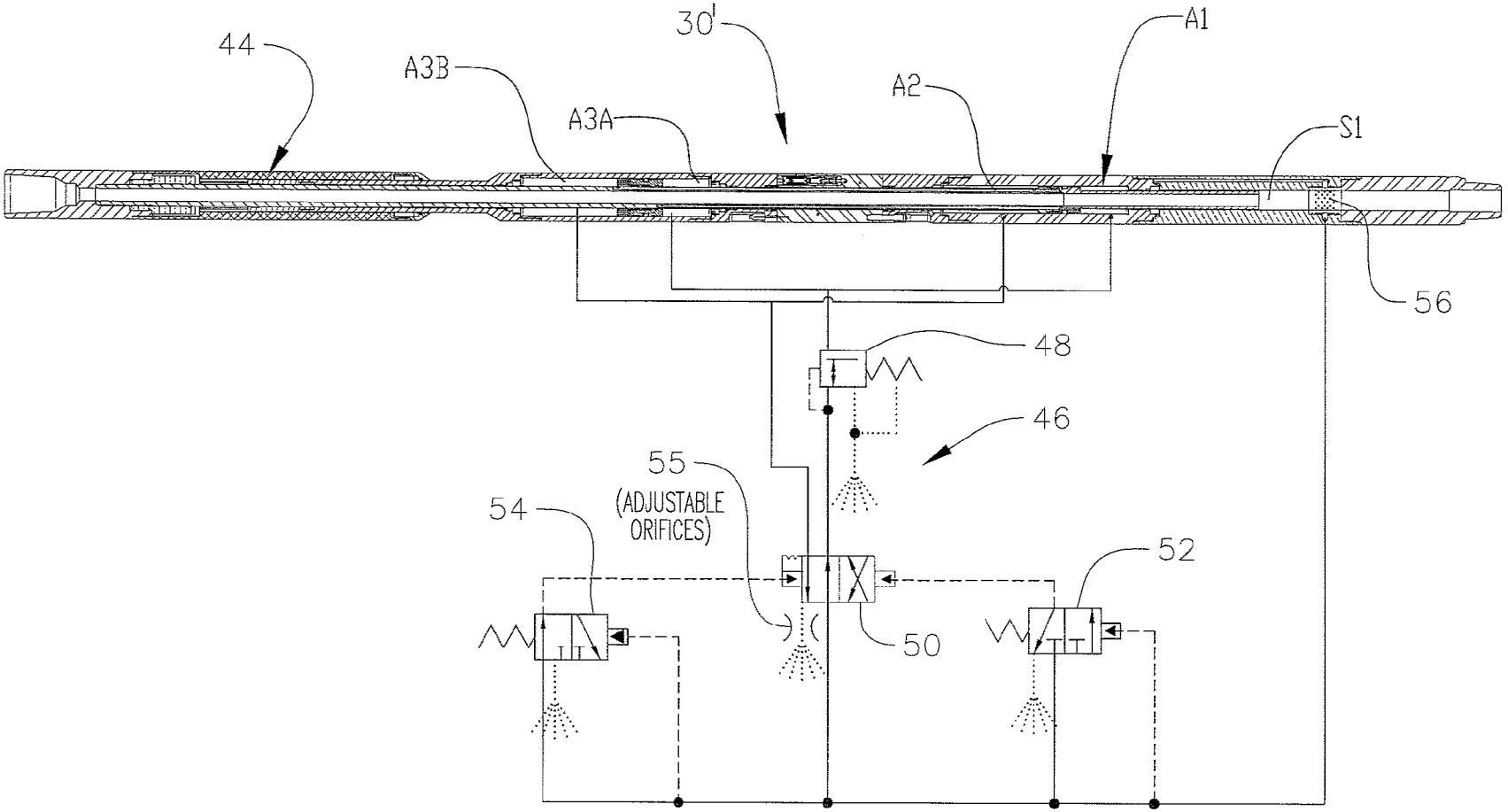
FIG. 4 is a cross-sectional view showing the anti-stall tool of FIG. 3 along with a schematic view of an improved controller.

FIGS. 3 and 4 show an improved anti-stall tool 30' which produces a three-stage controlled translational motion to the drill bit that increases drilling efficiency.

This illustrated embodiment includes a series of axially aligned hydraulic cylinders with pistons that cooperate to form piston areas S1, A1 and A2, and A3A and A3B. The torque section of the tool is shown at 44 along with a hydraulic controller contained in the anti-stall tool and shown schematically at 46. The controller includes a pressure control valve 48, a pilot valve 50, a sequence valve 52, and a vent valve 54. A filter for the hydraulic controller is shown at 56.

In one embodiment, the controller has the three stages of operation: (1) active, (2) passive, and (3) retraction. The control valves contained in the controller area of the tool are shown schematically in FIG. 4: pressure lines are shown as solid lines, pilot lines are shown as dashed lines, and exhaust lines are shown in dotted lines. In the following description, the pressure ranges are used as examples only; they are adjustable to specific motor requirements.

The active stage applies downward force to the drill bit based on motor back-pressure from the positive displacement motor. If pressure is less than 400 psi, for example, the hydraulic pistons apply a downward force which generates more PDM back-pressure. The vent valve 54 of the controller is open and supplies a pilot signal to the pilot valve 50. If pressure reaches 400 psi, the vent valve 54 closes and vents the pilot line for the pilot valve 50. But the detented pilot valve stays in position, and the PDM back-pressure is sensed by the pressure control valve 48. The pistons apply the downward force until sensed downhole pressure reaches 650 psi, for example, which represents a desired working pressure.

The pressure control valve then switches the anti-stall tool to the passive mode when sensed pressure reaches the desired drilling pressure of 650 psi, for example. Here the pressure control valve 48 shuts off flow to the pistons and hydraulically locks the pistons in the passive WOB mode. The pressure control valve 48 is closed and no pressure is sent to the pistons. The pistons are sealed, and existing force is transferred to the drill bit. Motor pressure is not increased. Downhole pressure continues to be monitored in the passive mode via the vent valve 54 and sequence valve 52, which monitor pressure change in the coiled tubing. The passive state continues until sensed back-pressure reaches 800 psi, for example.

Once downhole pressure reaches the 800 psi level, the anti-stall tool switches to the reverse mode. That is, if torque in the PDM increases, it causes an increase in back-pressure. Motor stall is prevented by sensing and reacting to back pressure at a level below motor stall, e.g., 800 psi, or other pressure below that at which stall can occur.

When sensed pressure reaches 800 psi, the normally-closed sequence valve 52 is opened, sending a pilot signal to the pilot valve 50 which reverses flow of hydraulic fluid to the pistons to produce a force in the uphole direction, to reduce WOB.

As back pressure falls below 800 psi, the pilot signal from the sequence valve 52 to the pilot valve 50 is closed. The sequence valve 52 vents the pilot signal, and this continues until sensed PDM pressure falls to 400 psi, where the vent valve 54 opens and sends a pilot signal to the pilot valve 50 to shift back to the active mode, by supplying fluid pressure to the pistons in the forward direction, to apply downward force to increase WOB.

Thus, in this embodiment, the tool is normally controlled to apply WOB when drilling at pressures within a desired wide range of pressures. These can be from 400 to 800 psi, for example. When reaching a preset anti-stall pressure, such as 800 psi, which would be a safe level below the pressure at which stall actually occurs, the tool is reversed and does not resume applying WOB over a preset wide range of pressure drop, before resuming active WOB operations. This wide range of pressure drop can be from about 200 to about 2,000 psi. In the illustrated embodiment, the range of pressure drop is 400 psi (from 800 to 400 psi), before WOB is resumed.

The tool applies WOB during the desired wide range of operating pressures via two stages, one stage where pressure is increasing up to a set desired operating pressure, for example 650 psi, and then switches to a second-stage locked position at that pressure and higher up until an anti-stall limit, of say 800 psi is reached, for reversing flow to the pistons and lifting the drill bit.

A key feature of the anti-stall tool is the single input necessary for the tool to operate. The tool need only sense and respond to the back-pressure created by the PDM. Stated another way, the anti-stall tool operates on constant (although adjustable) working pressure set points. The fixed set points can be fine-tuned to control the thresholds at which the control valves open and close, and as a result, drill bit penetration rate is more uniform.

An alternate embodiment of the invention comprises a two-phase anti-stall method for controlling drilling operations in a downhole assembly, which includes the tubing that extends downhole, the drill bit carried on the tubing, the positive displacement motor (PDM) for rotating the drill bit, and the anti-stall tool adjacent the PDM. This method comprises sensing pressure in the PDM, providing a range of operating pressures for the PDM defined by high and low limits of operating pressures, and operating the anti-stall tool in: (1) an active stage increasing WOB forces in the downhole direction when the low limit of operating pressure is sensed, and (2) a reverse stage providing a force in the reverse direction, reducing the WOB, when the high limit of operating pressure is sensed.

This two-phase anti-stall method can be accomplished by adjusting the setting of the sequence valve 52 equal to or lower than the pressure control valve 48, but still above the setting of the vent valve 54.

The anti-stall tool also can be operated by the two-phase method, combined with a passive range that operates (as described above) between a small range of pressure settings.

Different orifice adjustments can be used to control the speed at which the tool responds. In FIG. 2, the orifice is not shown. The orifice can be on the exhaust of the reverser valve 38.

Although the schematic in FIG. 4 depicts a single orifice 55, those skilled in the art would understand that the two-position/four-way valve contains two exhaust ports. Each of the ports vents a different piston area, either the piston area to produce downhole force (expand) or uphole force (retract). Using the high and low limits of the operating pressures, the orifice sizes can be calculated to restrict the volumetric flow rate of fluid exhausted through the valve and thereby control the speed at which the tool expands or retracts. The expansion and retraction of the tool can be controlled individually by different orifice sizes.

As an alternative, WOB can be controlled by a combination of control valve settings and adjustments to orifice sizes.

EXAMPLE

The following specifications illustrate one embodiment of the anti-stall tool:

| Description | Characteristic |
|---|---|
| Tool OD | 3.00 in |
| Tool ID | .75 in |
| Length—Expanded | 8.1 ft |
| Length—Collapsed | 7.4 ft |
| Stroke | 9 in |
| Max Temp | 300° F. |
| Tensile Strength | 50,000 lbs |
| Max Motor Torque | 2,000 ft-lbs |
| Max Dog Leg | 25°/100 ft |
| Tool Joint | 2⅜ PAC |

The design is flexible in that the pressure settings and orifice size may be changed to fine-tune the tool. If a much larger WOB change is needed, then the shaft can be replaced to allow installation of additional pistons.

| # of Pistons | Total Downhole Area (sq. in.) | Pressure Control Valve Setting (psi) | Max WOB from AST (lbs) |
|---|---|---|---|
| 1 | 4.8 | 650 | 3,055 |
| 2 | 7.9 | 650 | 5,135 |
| 3 | 11.0 | 650 | 7,150 |

The anti-stall tool cylinders and valves may be manufactured from various corrosion-resistant materials including tungsten carbide, Inconel, high strength nickel alloyed steel such as MP35, beryllium-copper, and the like.

Examples of improvements provided by the anti-stall tool are:

(1) Active WOB: The tool will attempt reset into the fully extended position when the pressure falls below 650 psi. If a motor stall has occurred and the AST has pulled the bit off bottom, the Active WOB stage will produce a minimum WOB and thrust the bit downhole until the PDM pressure exceeds 650 psi.

(2) Passive WOB: Shuts off the Active WOB stage and allows the coiled tubing to transfer WOB to the bit. Prevents excessive WOB that can be developed as PDM pressure rises and acts on the pistons producing force downhole.

(3) Reverse: Reduces WOB to prevent motor stalls.

(4) Torque section will transfer torque through the AST into the coiled tubing.

A downhole tool that monitors motor pressure and sharply reduces the occurrence of motor stalls will increase the overall drilling efficiency by:

(1) Increasing the average rate of penetration. This is achieved reducing the occurrences of pulling off bottom for motor stalls.

(2) Decreasing the damage to PDMs through repeated motor stalls, thereby decreasing occurrence of downhole failure.

(3) Decreasing the fatigue cycles on the coiled tubing. The increases the number of wells a coiled tubing string can service.

By achieving a more efficient drilling operation, the operators can substantially increase the cost savings of drilling a well.

Although the invention has been described in connection with oil well drilling and use with a coiled tubing, the invention has other applications, including: jointed pipe, or rotary drilling; in operations besides drilling where it is useful to retract a tool at high pressures; or where adjustments to the drill bit are made to keep contact with the formation or to pick up the bit completely off the formation. Although the invention has been described with reference to a drill bit used in drilling oil wells in underground formations, the invention also may be used with other pressure-inducing tools such as high pressure jetting tools.

What is claimed is:

1. A downhole assembly adapted for anti-stall drilling operations, the downhole assembly including a drill bit, a drive motor for rotating the drill bit, a tubing for supplying drilling fluid to the drive motor, and an anti-stall tool positioned between the tubing and the drive motor for hydraulically controlling the force applied to the drill bit during drilling operations, to thereby prevent the drill bit from stalling under load, the anti-stall tool comprising:

an outer housing, an internal passageway extending through the housing for transmitting drilling fluid from the tubing to the drive motor for rotating the drill bit, and a hydraulic controller contained in the outer housing, the controller comprising:

a piston assembly slidably disposed in the outer housing, said internal passageway extending through the piston assembly, the piston assembly comprising one or more hydraulic cylinders each having a piston therein for applying axial forces in either the downhole direction or the reverse direction to adjust weight-on-bit (WOB) while drilling, and a hydraulic control valve system contained in the outer housing with an inlet for receiving a supply of hydraulic control fluid from the drilling fluid in the internal passageway, for supplying the hydraulic control fluid to the piston assembly to control WOB;

the hydraulic control valve system including:

an adjustable first set point for indicating a desired lower limit for hydraulic working pressure of the drilling fluid in the tubing, and an adjustable second set point for indicating a desired upper limit for hydraulic working pressure of the drilling fluid in the tubing, the first and second set points representing a desired working pressure range for the drive motor, in which the first set point is provided by a vent valve that monitors the working pressure in the tubing and is open when the working pressure is below an adjustable preset lower pressure limit, and in which the vent valve closes when the working pressure reaches the preset lower limit, sending a first hydraulic pilot signal to a pilot valve, and in which the second set point is provided by a sequence valve that monitors the working pressure in the tubing and is closed when the working pressure is below an adjustable preset upper limit but opens when the working pressure reaches the upper limit, sending a second hydraulic pilot signal to the pilot valve;

an active stage valve assembly for sensing the working pressure in the tubing and supplying the hydraulic control fluid to one or more of the cylinders contained in the piston assembly to apply an axial force in the downhole direction to increase WOB when the sensed working pressure is below the first set point, in which the active stage valve assembly includes the pilot valve which opens in response to receiving the first pilot signal to supply hydraulic control fluid to the piston assembly through a pressure control valve which, in an open position thereof, controls the flow of hydraulic control fluid to the piston assembly to increase WOB;

a passive stage valve assembly for sensing the working pressure in the tubing and shutting off the hydraulic control fluid supplied to the piston assembly for maintaining WOB via the drilling fluid in the tubing, independent of the piston assembly, when the sensed working pressure is within the desired working pressure range of the drive motor, in which the passive stage valve assembly includes the pressure control valve which switches from the open position to a closed position when the sensed working pressure reaches a preset pressure value within the desired working pressure range, to stop the supply of hydraulic control fluid to the piston assembly and hydraulically lock the piston assembly in a passive state; and a reverse stage valve assembly for sensing the working pressure in the tubing and reversing the flow of the hydraulic control fluid supplied to one or more of the cylinders contained in the piston assembly to apply an axial force in the reverse direction to retract the drill bit to decrease WOB when the sensed working pressure reaches or exceeds the second set point, in which the reverse stage valve assembly responds to the second pilot signal sent from the sequence valve to the pilot valve, to reverse the supply of hydraulic control fluid to the piston assembly to decrease WOB, in which the sequence valve closes when sensed working pressure diminishes to a level below the preset upper limit, and in which the vent valve is maintained in a closed position until the first pilot signal is sent to the pilot valve to initiate the active stage.

2. The assembly according to claim 1 in which the second set point is adjustable to a working pressure level below motor stall.

3. The assembly according to claim 1 in which the reverse stage valve assembly monitors a drop in working pressure after said axial force is applied in the reverse direction, and switches the flow of control fluid to the active stage valve assembly when the drop in monitored working pressure reaches or surpasses the first set point.

4. The assembly according to claim 1 in which the drive motor is a positive displacement motor, and in which the tubing comprises a coiled tubing.

5. The assembly according to claim 1 in which the housing includes a spline connection for allowing the drive motor and the drill bit to maintain alignment with an orienting tool connected to an uphole side of the anti-stall tool.

6. The assembly according to claim 1 in which the pilot valve includes exhaust ports, the orifice sizes of which are adjustable for controlling drilling speed.

7. An anti-stall tool adapted for anti-stall drilling operations in a downhole assembly which includes a drill bit, a drive motor for rotating the drill bit, and a tubing for supplying drilling fluid to the drive motor, in which the anti-stall tool is positioned in the downhole assembly between the tubing and the drive motor for hydraulically controlling the force applied to the drill bit during drilling operations, to thereby prevent the drill bit from stalling under load, the anti-stall tool comprising:

an outer housing, an internal passageway extending through the housing for transmitting drilling fluid from the tubing to the drive motor for rotating the drill bit, and a hydraulic controller contained in the outer housing, the controller comprising:

a piston assembly slidably disposed in the outer housing, said internal passageway extending through the piston assembly, the piston assembly comprising one or more hydraulic cylinders each having a piston therein for applying axial forces in either the downhole direction or the reverse direction to adjust weight-on-bit (WOB) while drilling, and a hydraulic control valve system contained in the outer housing with an inlet for receiving a supply of hydraulic control fluid from the drilling fluid in the internal passageway, for supplying the hydraulic control fluid to the piston assembly to control WOB;

the hydraulic control valve system including:

an adjustable first set point for indicating a desired lower limit for hydraulic working pressure of the drilling fluid in the tubing, and an adjustable second set point for indicating a desired upper limit for hydraulic working pressure of the drilling fluid in the tubing, the first and second set points representing a desired working pressure range for the drive motor, in which the first set point is provided by a vent valve that monitors the working pressure in the tubing and is open when the working pressure is below an adjustable preset lower pressure limit, and in which the vent valve closes when the working pressure reaches the preset lower limit, sending a first hydraulic pilot signal to a pilot valve, and in which the second set point is provided by a sequence valve that monitors the working pressure in the tubing and is closed when the working pressure is below an adjustable preset upper limit but opens when the working pressure reaches the upper limit, sending a second hydraulic pilot signal to the pilot valve;

an active stage valve assembly for sensing the working pressure in the tubing and supplying the hydraulic control fluid to one or more of the cylinders contained in piston assembly to apply an axial force in the downhole direction to increase WOB when the sensed working pressure is below the first set point, in which the active stage valve assembly includes the pilot valve which opens in response to receiving the first pilot signal to supply hydraulic control fluid to the piston assembly through a pressure control valve which, in an open position thereof, controls the flow of hydraulic control fluid to the piston assembly to increase WOB;

a passive stage valve assembly for sensing the working pressure in the tubing and shutting off the hydraulic control fluid applied to the piston assembly for maintaining WOB via the drilling fluid in the tubing, independent of the piston assembly, when the sensed working pressure is within the desired working pressure range of the drive motor, in which the passive stage valve assembly includes the pressure control valve which switches from the open position to a closed position when the sensed working pressure reaches a preset pressure value within the desired working pressure range, to stop the supply of hydraulic control fluid to the piston assembly and hydraulically lock the piston assembly in a passive state; and a reverse stage valve assembly for sensing the working pressure in the tubing and reversing the flow of hydraulic control fluid applied to one or more of the cylinders contained in the piston assembly to apply an axial force in the reverse direction to retract the drill bit to decrease WOB when the sensed working pressure reaches or exceeds the second set point, in which the reverse stage valve assembly responds to the second pilot signal sent from the sequence valve to the pilot valve, to reverse the supply of hydraulic control fluid to the piston assembly to decrease WOB, in which the sequence valve closes when sensed working pressure diminishes to a level below the preset upper limit, and in which the vent valve is maintained in a closed position until the first pilot signal is sent to the pilot valve to initiate the active stage.

8. The anti-stall tool according to claim 7 in which the second set point is adjustable to a back pressure level below motor stall.

9. The anti-stall tool according to claim 7 in which the reverse stage valve assembly monitors a drop in working pressure after said axial force is applied in the reverse direction, and switches the flow of control fluid to the active stage valve assembly when the drop in monitored working pressure reaches or surpasses the first set point.

10. The anti-stall tool according to claim 7 in which the drive motor is a positive displacement motor, and in which the tubing comprises a coiled tubing.

11. The anti-stall tool according to claim 7 in which the housing includes a spline connection for allowing the drive motor and the drill bit to maintain alignment with an orienting tool connected to an uphole side of the anti-stall tool.

12. The anti-stall tool according to claim 7 in which the pilot valve includes exhaust ports, the orifice sizes of which are adjustable for controlling drilling speed.

13. An anti-stall method for adjusting weight-on-bit (WOB) in a downhole assembly which includes a drill bit, a drive motor for rotating the drill bit, and a tubing for supplying drilling fluid to the drive motor, the method comprising providing an anti-stall tool positioned between the tubing and the drive motor for hydraulically controlling the force applied to the drill bit during drilling operations, to thereby prevent the drill bit from stalling under load, the anti-stall tool including:

an outer housing, an internal passageway extending through the housing for transmitting drilling fluid from the tubing to the drive motor for rotating the drill bit, and a hydraulic controller contained in the outer housing, the controller comprising:

a piston assembly slidably disposed in the outer housing, said internal passageway extending through the piston assembly, the piston assembly comprising one or more hydraulic cylinders having a piston therein for applying axial forces in either the downhole direction or the reverse direction to adjust weight-on-bit (WOB) while drilling, and a hydraulic control valve system contained in the outer housing with an inlet for receiving a supply of hydraulic control fluid from the drilling fluid in the internal passageway, for supplying the hydraulic control fluid to the piston assembly to control WOB;

the method further including providing a valve-controlled adjustable first set point for indicating a desired lower limit for hydraulic working pressure of the drilling fluid in the tubing, and providing a valve-controlled adjustable second set point for indicating a desired upper limit for hydraulic working pressure of the drilling fluid in the tubing, the first and second set points representing a desired working pressure range for the drive motor;

in which the first set point is provided by a vent valve that monitors the working pressure in the tubing and is open when the working pressure is below an adjustable preset lower pressure limit, and in which the vent valve closes when the working pressure reaches the preset lower limit, sending a first hydraulic pilot signal to a pilot valve, and in which the second set point is provided by a sequence valve that monitors the working pressure in the tubing and is closed when the working pressure is below an adjustable preset upper limit but opens when the working pressure reaches the upper limit, sending a second hydraulic pilot signal to the pilot valve; and operating the anti-stall tool in stages (1), (2), and (3):

(1) an active stage in which an active stage valve assembly senses the working pressure in the tubing and supplies the hydraulic control fluid to one or more of the cylinders contained in piston assembly to apply an axial force in the downhole direction to increase WOB when the sensed working pressure is below the first set point, in which the active stage valve assembly includes the pilot valve which opens in response to receiving the first pilot signal to supply hydraulic control fluid to the piston assembly through a pressure control valve which, in an open position thereof, controls the flow of hydraulic control fluid to the piston assembly to increase WOB;

(2) a passive stage in which a passive stage valve assembly senses the working pressure in the tubing and shuts off the flow of the control fluid to the piston assembly for maintaining WOB via the drilling fluid in the tubing, independent of the piston assembly, when the sensed working pressure is within the desired working pressure range, in which the passive stage valve assembly includes the pressure control valve which switches from the open position to a closed position when the sensed working pressure reaches a preset pressure value within the desired working pressure range, to stop the supply of hydraulic control fluid to the piston assembly and thereby hydraulically lock the piston assembly in a passive state; and (3) a reverse stage in which a reverse stage valve assembly senses the working pressure in the tubing and reverses the flow of hydraulic control fluid supplied to one or more of the cylinders contained in the piston assembly to apply an axial force in the reverse direction to retract the drill bit to decrease WOB when the sensed working pressure reaches or exceeds the second set point, in which the reverse stage valve assembly responds to the second pilot signal sent from the sequence valve to the pilot valve, to reverse the supply of hydraulic control fluid to the piston assembly to decrease WOB, in which the sequence valve closes when sensed working pressure diminishes to a level below the preset upper limit, and in which the vent valve is maintained in a closed position until the first pilot signal is sent to the pilot valve to initiate the active stage.

14. The method according to claim 13 in which the second set point is adjustable to a back pressure level below motor stall.

15. The method according to claim 13 in which a drop in working pressure is monitored after said axial force is applied in the reverse direction, and the flow of control fluid is switched to the active stage when the drop in monitored working pressure reaches or surpasses the first set point.

16. The method according to claim 13 in which the drive motor is a positive displacement motor, and in which the tubing comprises a coiled tubing.

17. The method according to claim 13 in which the pilot valve includes exhaust ports, the orifice sizes of which are adjustable for controlling drilling speed.

18. The method according to claim 13 in which sensed working pressure of the drilling fluid is monitored at a surface location, and including the step of adjusting downhole tubing injector rates in response to the monitored sensed working pressure.

* * * * *